US005813469A

United States Patent [19]

Bowlin

[11] Patent Number: 5,813,469

[45] Date of Patent: Sep. 29, 1998

[54] COUPLED DOWNHOLE PUMP FOR SIMULTANEOUS INJECTION AND PRODUCTION IN AN OIL WHEEL

[75] Inventor: Kevin R. Bowlin, Sugar Land, Tex.

[73] Assignee: Texaco Inc., White Plains, N.Y.

[21] Appl. No.: 814,918

[22] Filed: Mar. 12, 1997

[51] Int. Cl.[6] ..... E21B 43/12

[52] U.S. Cl. ..... 166/369; 166/68

[58] Field of Search ..... 166/68, 369, 105, 166/65.1, 106

[56] References Cited

U.S. PATENT DOCUMENTS

| | | | |
|---|---|---|---|
| 3,736,983 | 6/1973 | Beard et al. | 166/68 X |
| 4,768,595 | 9/1988 | Smith | 166/68 X |
| 4,934,458 | 6/1990 | Warburton et al. | 166/68 X |
| 5,033,545 | 7/1991 | Sudol | 166/68 X |
| 5,139,400 | 8/1992 | Ide . | |
| 5,296,153 | 3/1994 | Peachey . | |
| 5,417,281 | 5/1995 | Wood et al. | 166/68 |
| 5,421,780 | 6/1995 | Vukovic . | |
| 5,447,472 | 9/1995 | Ide . | |

*Primary Examiner*—Frank Tsay
*Attorney, Agent, or Firm*—Henry H. Gibson; Arnold White & Durkee

[57] ABSTRACT

An apparatus for the downhole production of hydrocarbons. The apparatus includes a first pump coupled to a second pump. The first pump is powered by injection fluid contained in the tubing string; thus, eliminating the need for electrical connection cables or rotating rods. Typically, the second pump is powered by the first pump. The apparatus is capable of simultaneous injection and hydrocarbon production in a single wellbore. The coupling of the first and second pumps may further include a cross-over piece wherein the injection fluid and hydrocarbon production bypass one another.

17 Claims, 4 Drawing Sheets

COUPLED DOWNHOLE PUMP FOR SIMULTANEOUS INJECTION AND PRODUCTION IN AN OIL WHEEL

BACKGROUND OF THE INVENTION

1. Field of the Invention

The present invention is generally directed to an apparatus used in the production of hydrocarbons. More specifically, the present invention is directed to coupled downhole pumps for the simultaneous production and injection in a well bore with one tubing string.

2. Background

The geological formations in many oil fields are complex and it is not uncommon for an oil well to encounter more than one oil producing formation. For example in the Zamrud oil field in Indonesia, one oil producing formation, called the Bekasap formation, lies on top of a second producing formation, the Bangko formation. In such situations it is common to produce oil from the formation that allows for the most economical production of oil, while the other formation is idled due to vastly differing bottom hole pressures.

Upon completion of the primary production activity of the first formation, secondary production techniques such as water flooding or injection fluid flooding are commonly initiated in the now depleted formation. In order to do so, new injection wells are drilled or selected primary production wells are converted into injection wells for use in the secondary production process. Due to the high fluid injection rates often required from the injection wells, well casing strings of standard diameter (e.g. 4 ½", 5 ½" or 7") do not allow for the simultaneous injection of injection fluid into the depleted formation and the primary production of the other formation.

One solution to this problem is to redrill the well with an oversized casing string(e.g. 9 ⅝"). However in many locations this is not possible due to the remote location, a lack of knowledge or equipment at the well head to operate dual strings and oversized casings operations or the extra cost of conducting such operations. Therefore it is common to forgo the production of the other formation in favor of conducting the secondary production activity in the previously depleted formation.

One technology to address the above situation in high water cut oil wells is disclosed in U.S. Pat. No. 5,296,153 in which a downhole pump uses a cyclone separator to separate the water component of the production fluid from the oil component of the production fluid. The oil component is lifted to the surface by conventional means and the water component is injected into an underlying formation. In order to adapt such technology to a well in which water injection and oil production is desired, a water cut greater than 80% is needed. The water cut of an oil well is the percentage of the production fluid that is mostly water. Drawbacks of this technology include: (a) the injection well must encounter a high water cut producing formation; (b) the technology reinjects the production fluid water and does not allow for the injection of specially formulated injection fluids and (c) special connections to the surface, be it mechanical (i.e. sucker rod or rotating rod), electrical (i.e. electric cables), or hydraulic (i.e. pressurized fluid lines) are needed to power any downhole pump needed to artificially lift the oil component of the production fluid to the surface.

Therefore, there remains an unmet need for a method of operating an oil well as a secondary production injection well while simultaneously operating the well in the primary production of an under or overlying formation. Particularly, there is a need to simultaneously perform injection and production operations in a single wellbore with a single tubing string. Such an invention would alleviate the need to drill a separate injection well when either: (1) two formations are encountered by a single well and one of them is a depleted formation while the other is a producing formation, or (2) a single formation is depleted to the extent that flooding operations are necessary. Moreover, there is a need to perform the above downhole operations in unlimited water cut percentage conditions.

SUMMARY OF THE INVENTION

The following invention overcomes the time consuming and expensive need of drilling separate injection and production wells by allowing for either: (1) the simultaneous occurrence of injection and production operations on a single tubing string in a single well bore, or (2) the readily and inexpensive conversion of a production well to an injection well once a formation becomes sufficiently depleted. In addition, even if injection operations are not needed, the following invention provides for an advantageous method of powering the producing pump over conventional methods. Moreover, the following invention operates in any water cut conditions.

The following invention generally comprises a coupled pump configuration. Typically, a driver pump is coupled to a production pump. Advantageously, the driver pump powers the production pump. The coupled pump configuration is able to perform injection and production operations simultaneously in a wellbore. More particularly, the coupled pumps operate on a single drill string. Such an arrangement alleviates the need for the drilling of a separate injection well to flood a depleted formation. Moreover, such an arrangement allows for the readily and inexpensive conversion of a production well to an injection well.

BRIEF DESCRIPTION OF THE DRAWINGS

These and other features of the present invention are more fully set forth in the following description of illustrative embodiments of the invention. The description is presented with reference to the accompanying drawings in which.

Figure 1:
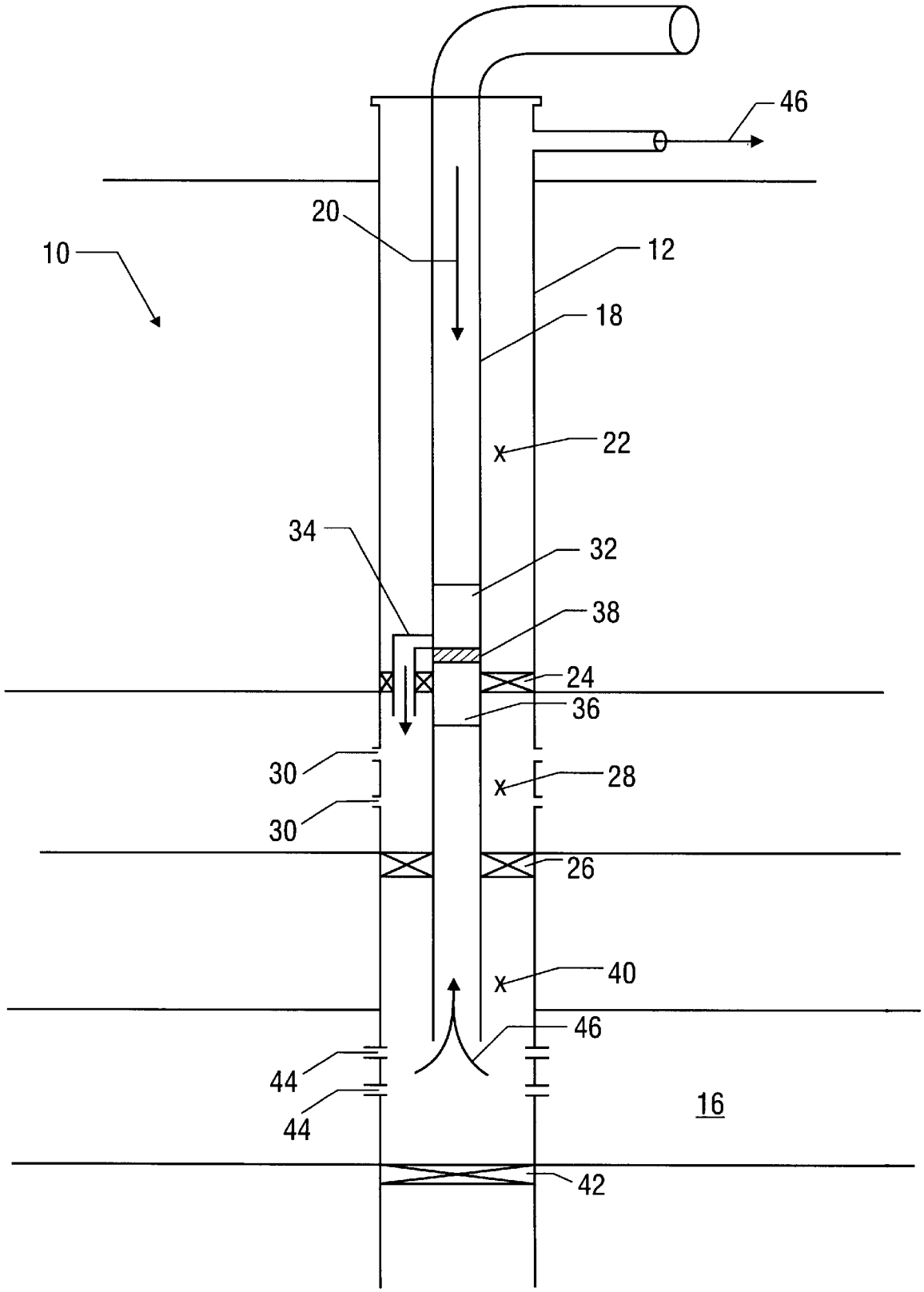
FIG. 1 is a cross-sectional illustration of an embodiment of the present invention
Figure 2:
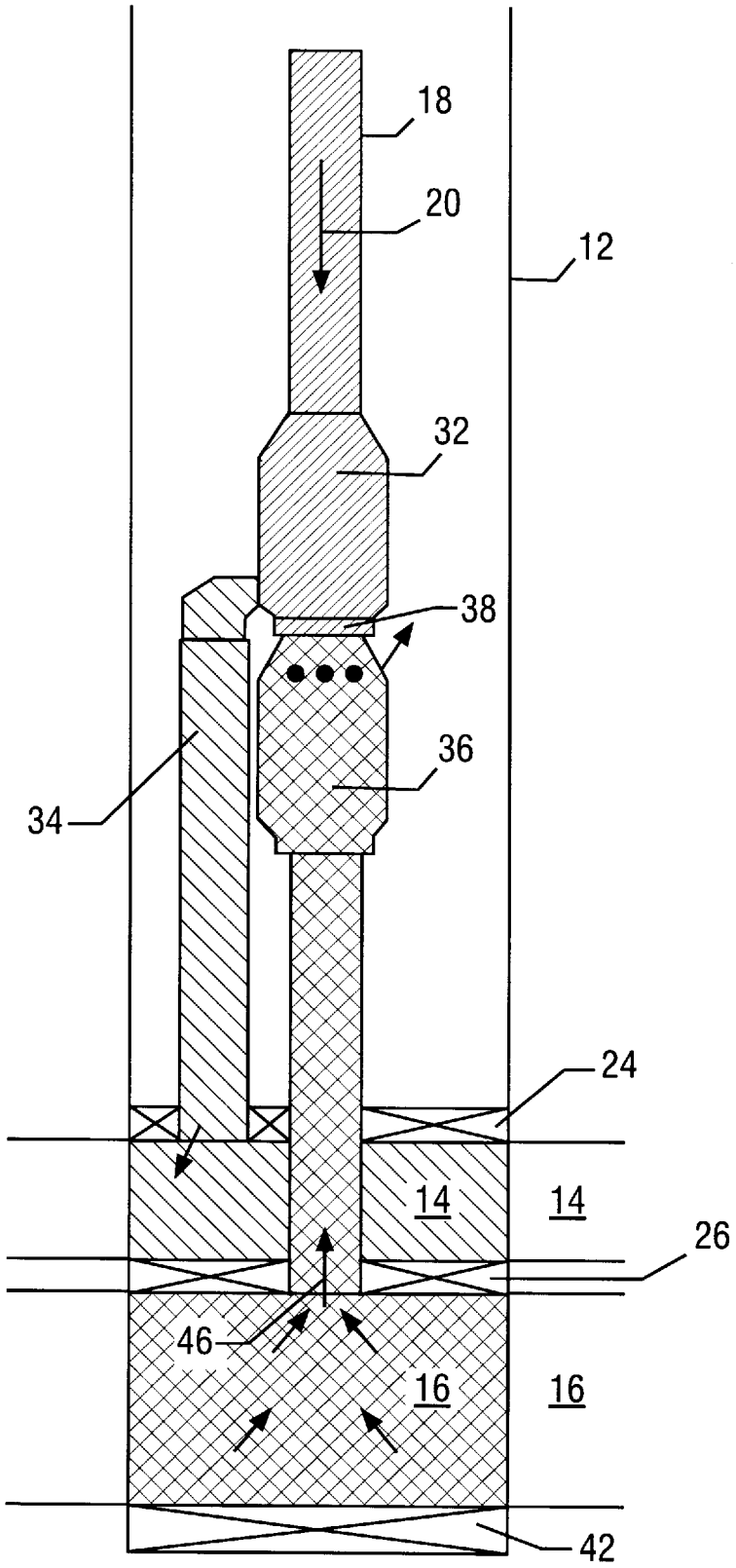
FIG. 2 is a side view illustration of the embodiment of FIG. 1.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DESCRIPTION OF ILLUSTRATIVE EMBODIMENTS

Illustrated in FIG. 1 is a cross-sectional view of an embodiment of the present invention as used in an oil well generally indicated by arrow 10. The oil well comprises a casing string 12 which passes through an injection formation 14 into which injection fluid is to be injected and a production formation 16 from which primary production is desired. A tubing string 18 within the casing string 12 extends downhole and serves as a conduit for the injection fluid the flow of which is generally indicated by arrow 20. An upper annulus 22 is formed between the casing string 12 and the tubing string 18 and is used as a conduit to bring the production fluid to the surface. An upper packer 24 and a middle packer 26 are vertically located within the annulus between the tubing sting and the casing string just above and below the injection formation. The injection chamber 28 formed by the upper packer 24 and the middle packer 26 is in fluid connection with the injection formation 14 by means of a plurality of injection ports 30. The injection chamber 28 is also in fluid connection with the output of a driver pump 32 by way of a driver pump output tube 34. The driver pump 32 is in fluid connection with the tubing string 18 so that the injection fluid sent from the surface under pressure is forced to pass through the driver pump 32 thus generating a driving motion. The injection fluid that flows from the output of the driver pump 32 retains sufficient pressure for the injection of the injection fluid into the injection formation 14. The driving motion generated by the flow of injection fluid through the driver pump 32 is transferred to a production pump 36 by way of a coupling means 38. Suitable coupling means should be apparent to one of ordinary skill in the art as illustrated by U.S. Pat. Nos. 5,139,400; 5,421,780; and, 5,447,472, the contents of which are hereby incorporated herein by reference.

As the name implies, the production pump 32 is used to pump a primary production fluid from the producing formation 16 to the surface. The production fluid is provided by the producing formation 16 by way of a production chamber 40 which is vertically located between the middle packer 26 and the lower packer 42. A portion of the tubing string below the production pump allows for fluid communication between the production chamber 40 and the production pump 36. A plurality of production perforations 44 in the casing string 12 provide a fluid connection between the production chamber 40 and the producing formation 16. The flow of the production fluid from the production chamber 40 to the surface is generally shown by arrows 46. The output of the production pump is in fluid connection with the upper annulus through which the production fluid is lifted to the surface.

The driver pump 32 and the production pump 36 have been illustrated as simple boxes for the purpose of simplicity and one skilled in the art should appreciate that these pumps are actually more complex. Pumps suitable for use in the present invention include progressive cavity pumps (PCP) and electric submersible pumps (ESP). However, these type of pumps are listed for illustrative purposes only as the invention may be implemented with many other types of pumps. The mechanical elements and the working of such pumps should be well known to one of ordinary skill in the art.

An important aspect of the present invention is that unlike the prior art uses for these pumps, which require either a physical connection (rotating rod) or electrical connection (electric power wires) to provide downhole operating power, the pumps of the present invention do not require such connections to operate. The power to operate the production pump is provided downhole by the flow of injection fluid through the driver pump. This flow is created by the pressure drop between the injection fluid in the tubing string above the driving pump and the pressure of the injection fluid in the injection chamber. The use of this pressure difference to power the driver pump and thus the production pump allows for the use of the well to simultaneously conduct injection activity and primary production activity.

In a related aspect of the present invention, it has been found that a reduction in the amount of maintenance needed to operate the downhole production pump is realized. By eliminating the need for a rotating rod or electric power cables, the periodic service and replacement of these elements is not needed. Typically, such service is needed every 3–4 months and requires the halting of well activity for at least two weeks. With the application of the present invention, this downtime is greatly reduced or eliminated and production of between about 2000 bbl/day and 100,000 bbl/day can continue. Over the course of a year this results in between about 42 to 56 additional days of production which means an additional oil production of between about 84,000 bbl to about 5,600,000 bbl in addition to the savings in labor and materials needed to carry out the maintenance service.

Figure 3:
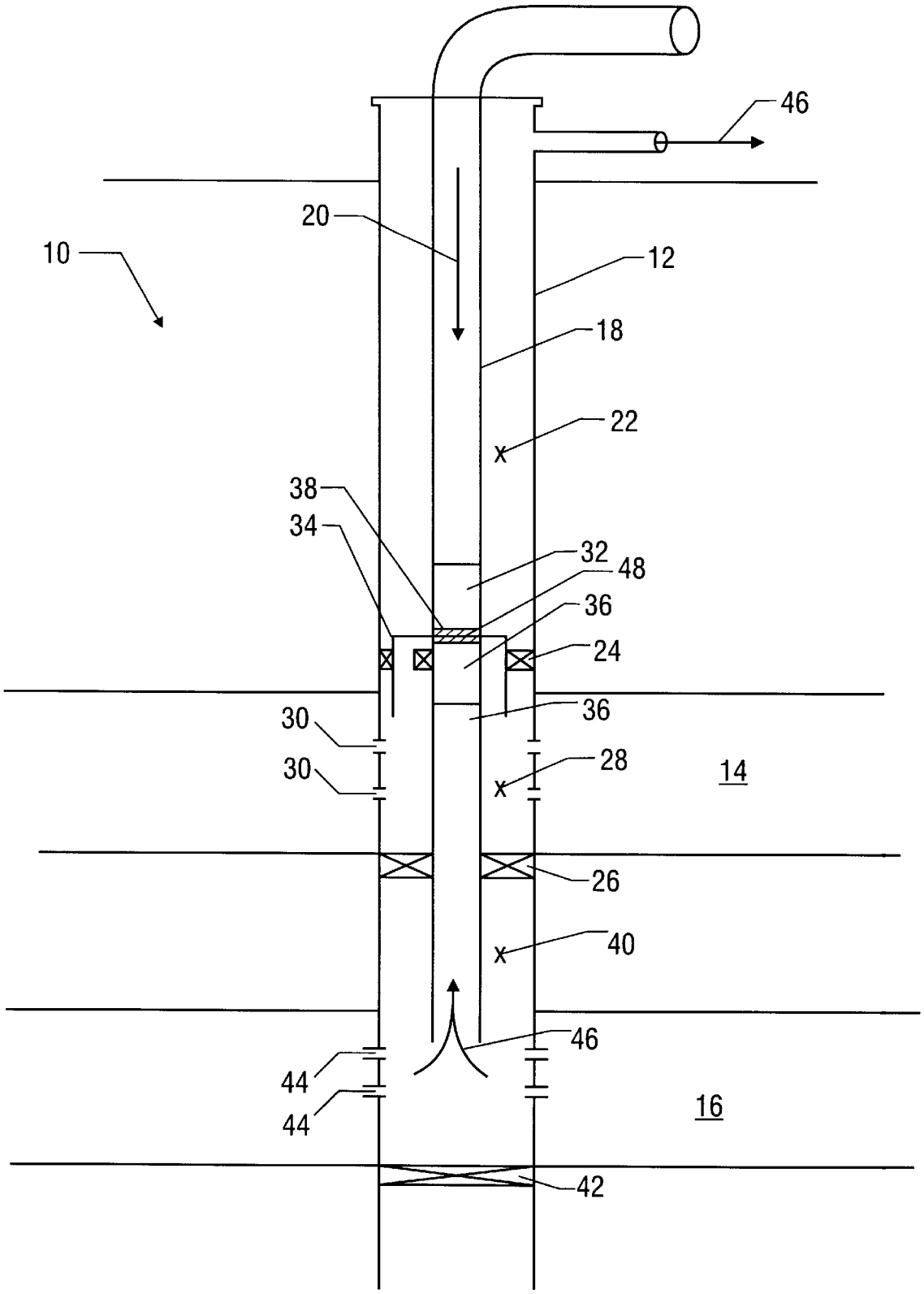
FIG. 3 is a cross-sectional illustration of a second embodiment of the present invention.
Figure 4A:
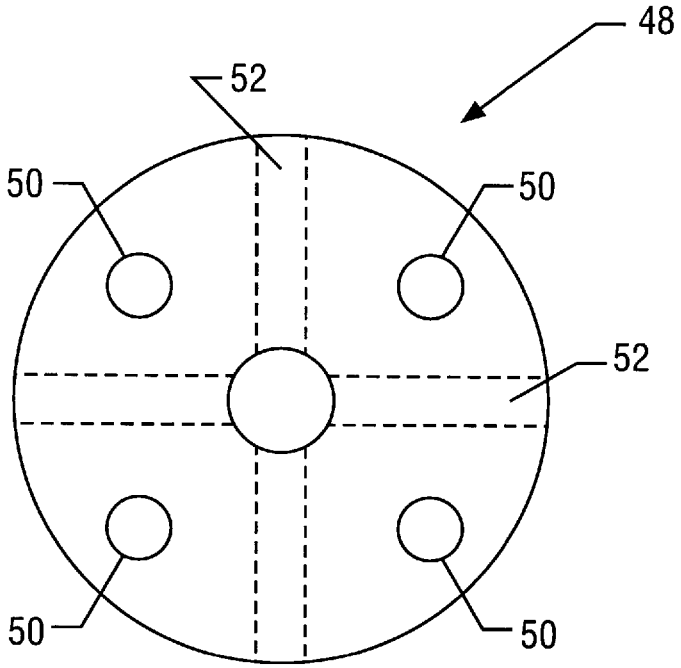
FIGS. 4A and 4B are top and cross-sectional views, respectively, of the cross-over piece.
Figure 4B:
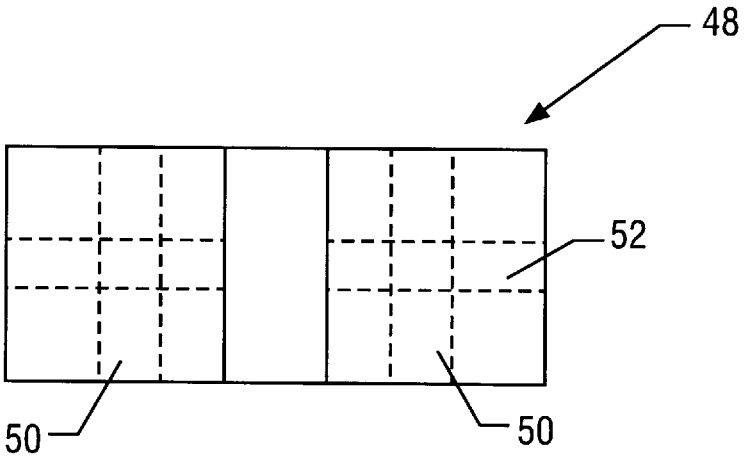

Turning now to FIG. 3, an alternative embodiment of the present invention is illustrated. Elements previously described above for FIG. 1 have been given the same reference number. In this particular embodiment, the driver pump output tube is concentric with the casing string and the tubing string. The injection fluid output of the driver pump 32 remains in fluid communication with the injection chamber 28 by means of a cross-over piece 48. Likewise, the output of the production pump 36 is in fluid communication with the upper annulus 22 and hence the surface by way of the cross-over piece 48. In other words, cross-over piece 48 allows the injection fluid and hydrocarbon production to bypass one another. Typically, the cross-over piece is a shroud having nonintersecting passageways. The cross-over shroud may take the form of the structure shown in FIGS. 4A and 4B where passageways 50 provide longitudinal passage of either the injection fluid or hydrocarbon production, while passageways 52 provide radial passage of the other.

An unexpected benefit of the present invention is realized when an excess of natural pressure exists in the producing formation. In such an embodiment, the roles of the driver pump and the production pump are reversed. That is to say, the natural pressure of the producing formation is used to create power downhole yet still allow for the natural lift of the production fluid to the surface. The power created by the production pump is used to drive the driver pump. In this case the driver pump pressurizes the injection fluid which is injected into the injection formation. In such an embodiment, the pressure needed for the injection operation is created downhole eliminating the need for injection pumps on the surface. One skilled in the art should appreciate the benefits of this embodiment, however it will also be appreciated that a limited number of wells exist where the natural pressure of the production fluid is sufficient to both naturally lift the production fluid to the surface and drive a pump that pressurizes an injection fluid.

While the structures and methods of the present invention have been described in terms of preferred embodiments, it will be apparent to those of skill in the art that variations may be applied to the what has been described herein without departing from the concept, spirit and scope of the invention. All such similar substitutes and modifications apparent to those skilled in the art are deemed to be within the spirit, scope and concept of the invention as it is set out in the following claims.

What is claimed is:

1. A coupled downhole pump comprising:

a driver pump;

a production pump;

coupling means for connecting the driver pump to the production pump; and a tubing string, the tubing string containing a pressurized injection fluid and being in fluid communication with the driver pump so that at least a portion of the pressurized injection fluid is used by the driver pump to create a driving motion which is transferred to the production pump by the coupling means.

2. The apparatus recited in claim 1 further comprising:

a casing string surrounding the tubing string thus forming an annulus therebetween;

a upper packer vertically positioned in the annulus above a injection formation;

a middle packer vertically positioned in the annulus below the injection formation but above a production formation, the upper and middle packer forming an injection chamber, the injection chamber being in fluid communication with the injection formation by means of a plurality of injection perforation in the casing string; and a driver pump output tube, the driver pump output tube being in fluid connection with the driver pump and the injection annulus so that the injection fluid flows from the tubing string through the driver pump and the driver pump output tube to the injection chamber.

3. The apparatus recited in claim 2 further comprising:

a lower packer vertically positioned below the production formation so as to form a production chamber the production chamber being in fluid communication with the production formation by way of a plurality of production perforations in the casing string; and means for fluid communication between the production chamber and the production pump.

4. The apparatus recited in claim 1 wherein the driver pump and the production pump are selected from the group consisting of electric submersible pumps, and progressive cavity pumps.

5. A method of using a well for injection and production comprising the steps of:

placing a driver pump downhole;

coupling the driver pump to a production pump so that the driver pump is in fluid communication with a tubing string, said tubing string containing a pressurized injection fluid for injection into an injection formation; and at least a portion of the pressure of the injection fluid is used by the driver pump to create a driving motion and the driving motion is used by the production pump to lift a production fluid.

6. The method of claim 5 wherein the driver pump and the production pump are selected from the group consisting of electric submersible pumps and progressive cavity pumps.

7. An apparatus for simultaneous injection and production in a wellbore comprising:

a first pump for injecting an injection fluid into a flood zone;

a second pump for producing hydrocarbons form a producing zone;

a tubing string; and a means for coupling said first and second pumps to allow for simultaneous operation of said pumps on said tubing string, said means including a cross-over piece for allowing said injection fluid and said hydrocarbon production to bypass one another.

8. The apparatus of claim 7 wherein said first pump is a driver pump and said second pump is a production pump.

9. The apparatus of claim 7 wherein said cross-over piece is a shroud having separate passageways for said injection fluid and said hydrocarbon production such that they bypass one another without mixing.

10. The apparatus of claim 9 wherein said cross-over piece is a single piece.

11. An apparatus for the downhole production of hydrocarbons comprising:

a tubing string, said tubing string containing a first pump and a second pump, said first pump is powered by the flow of injection fluid, and said second pump is coupled to, and powered by, said first pump.

12. The apparatus of claim 11 wherein said first and second pumps are selected from the group of electric submersible pumps and progressive cavity pumps.

13. The apparatus of claim 11 further comprising a cross-over shroud, said cross-over shroud having separate passageways providing for the separate passage of injection fluid and hydrocarbon production.

14. A method of simultaneous downhole hydrocarbon production and injection comprising the steps of:

placing a tubing string downhole, said tubing string having a first pump and a second pump, said first and second pumps are coupled so that said second pump is powered by said first pump;

providing an injection fluid in said tubing string so that at least a portion of said injection fluid powers said first pump and a portion of said injection fluid is injected into a downhole formation, and wherein said second pump lifts hydrocarbon production to the surface.

15. The method of claim 14 wherein a cross-over shroud is provided to allow said injection fluid to bypasss said second pump, and allow said hydrocarbon production to bypass said first pump.

16. An apparatus for the downhole production of hydrocarbons, comprising:

a tubing string; said tubing string containing a pressurized injection fluid;

a first pump powered by the pressurized injection fluid contained in said tubing string;

a second pump coupled to, and powered by, said first pump, said second pump produces hydrocarbon to the surface; and a cross-over piece having non-intersecting passageways for the bypass flow of said injection fluid and hydrocarbon production such that said injection fluid is injected into a desired formation and said hydrocarbon production is lifted to the surface simultaneously without substantial mixing.

17. The apparatus of claim 16 wherein said first and second pumps are selected from the group consisting of electric submersible pumps, and progressive cavity pumps.

* * * * *

UNITED STATES PATENT AND TRADEMARK OFFICE

CERTIFICATE OF CORRECTION

PATENT NO. : 5,813,469

DATED : September 29, 1998

INVENTOR(S) : Kevin R. Bowlin

It is certified that error appears in the above-identified patent and that said Letters Patent is hereby corrected as shown below:

On the title page, item [54] and col. 1, line 3:

In the title, please change the last word of "WHEEL" to "WELL".

and

In Column 5, Line 63, change "hydrocarbons form" to "hydrocarbons from"

Signed and Sealed this

Twentieth Day of April, 1999

*Attest:*

Q. TODD DICKINSON

*Attesting Officer*

*Acting Commissioner of Patents and Trademarks*